US005702016A

United States Patent [19]

Jang

[11] Patent Number: 5,702,016

[45] Date of Patent: Dec. 30, 1997

[54] BRAUN TUBE FOR A PROJECTION TELEVISION RECEIVER

[75] Inventor: Dug Gyu Jang, Kyungsangbuk-do, Rep. of Korea

[73] Assignee: Goldstar Co., Ltd., Seoul, Rep. of Korea

[21] Appl. No.: 359,209

[22] Filed: Dec. 19, 1994

[30] Foreign Application Priority Data

Sep. 16, 1994 [KR] Rep. of Korea ..... 23677

[51] Int. Cl.[6] ..... H01J 29/00; H01K 1/28

[52] U.S. Cl. ..... 220/2.3 A; 220/2.1 A; 313/461

[58] Field of Search ..... 220/2.1 A, 2.3 A, 220/2.1 R, 2.3 R; 313/461; 348/776

[56] References Cited

U.S. PATENT DOCUMENTS

| | | | |
|---|---|---|---|
| 4,535,907 | 8/1985 | Tokita et al. | 220/2.1 A |
| 4,570,101 | 2/1986 | Campbell | 313/461 |
| 4,884,879 | 12/1989 | Fukuda et al. | 350/432 |
| 5,029,993 | 7/1991 | Fukuda et al. | 350/432 |
| 5,107,999 | 4/1992 | Canevazzi | 313/461 X |
| 5,272,540 | 12/1993 | Hirata et al. | 358/237 |

FOREIGN PATENT DOCUMENTS

| | | | |
|---|---|---|---|
| 0112543 | 6/1984 | Japan | 220/2.3 A |
| 0168615 | 7/1988 | Japan | 313/461 |
| 3078948 | 4/1991 | Japan | 313/461 |

*Primary Examiner*—Allan N. Shoap
*Assistant Examiner*—Niki M. Kopsidas
*Attorney, Agent, or Firm*—Fish & Richardson P.C.

[57] ABSTRACT

A Braun tube for a projection television receiver in which homogeneity of luminance in the peripheral portion of a screen is obtained by setting the screen width-to-length ratio to 16:9 with the curvature radius of the long side is less than that of the short side when the fluorescent surface is viewed from the outer circumference of a panel so that the main axis of the light incident to the peripheral portion of the screen is refracted more toward the center portion of the screen than the other portion thereof.

2 Claims, 2 Drawing Sheets

(On the occasion of having a large radius)

(On the occasion of having a small radius)

FIG. 3
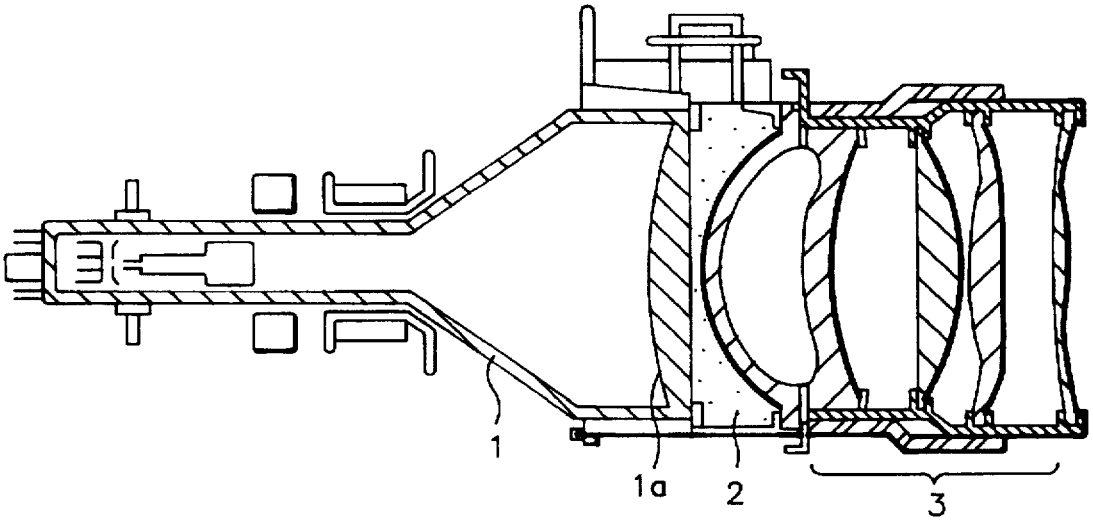
FIG. 4a
PRIOR ART
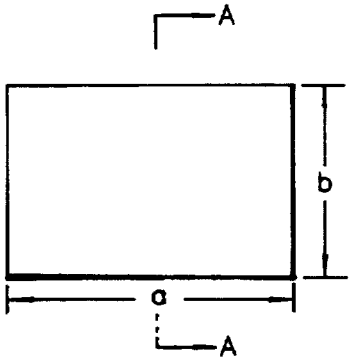
FIG. 5a
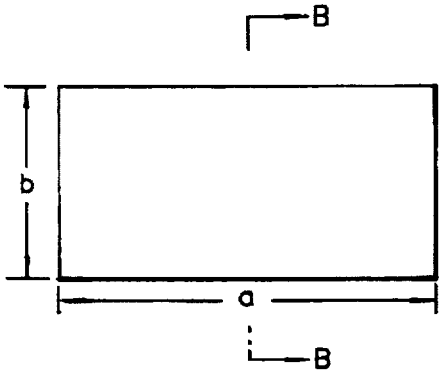
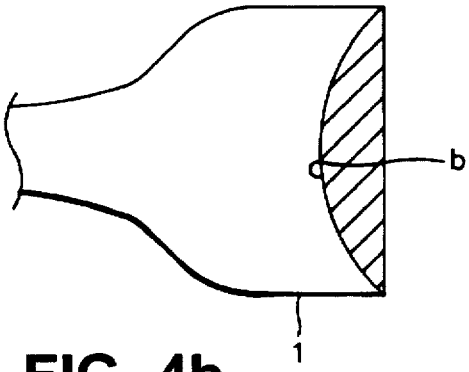
FIG. 4b
PRIOR ART
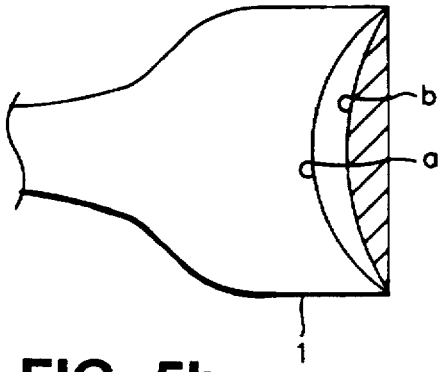
FIG. 5b

BRAUN TUBE FOR A PROJECTION TELEVISION RECEIVER

BACKGROUND OF THE INVENTION

The present invention relates to a Braun tube for a projection television receiver, and more particularly, to a Braun tube for a projection television receiver in which the homogeneity of luminance in the peripheral portion of a screen is obtained by setting the screen width-to-length ratio to 16 to 9.

FIG. 1 is a schematic diagram explaining geometric properties of light. The light radiated from a fluorescent surface 1*a* exhibits a Lambert's distribution if the fluorescent surface 1*a* is homogeneous. That is to say, when the main axis is the normal direction of the radiation surface and the intensity of the main axis is $B_0$, the intensity of all light beams decreases to $B_0 \cdot COS\ \theta$ at an inclination angle $\theta$.

Based on this principle, if the fluorescent surface is plane as shown in FIG. 1A, a substantial amount of light of the screen periphery cannot be incident to an entrance pupil of the projection lens. However, if the light impinges on a portion "A" of the fluorescent surface 1*a* having a curvature as shown in FIG. 1B, the light is incident being slanted in the projection axis (X axis) direction. Thus, the amount of the light incident to the entrance pupil of the projection lens increases.

FIG. 2 is a schematic diagram explaining Snell's law. Refraction of the light with the fluorescent surface having a curvature will now be described with reference to FIG. 2, which is indicated by the main axis of the light. The light is refracted as the light passes from a medium whose refractive index is $\eta_1$ to a medium whose refractive index is $\eta_2$. In accordance with Snell's law, the refracted light is defined by the following equation, $\eta_1 \cdot SIN\ \theta = \eta_2 \cdot SIN\ \phi$. That is to say, with respect to the same medium, if the radius of curvature is small, the refraction occurs with a large angle. As shown in FIG. 2, the screen shown in FIG. 2A has a larger curvature than that of the screen shown in FIG. 2B. Therefore, the refraction angle of the light incident to the portion "B" in FIG. 2A with respect to the projection axis is smaller than that in FIG. 2B. The aforementioned refraction angles can be represented as $\alpha$ for a larger radius and $\beta$ for a smaller radius.

Accordingly, in a Braun tube for a projection television receiver (to be referred as "projection TV" hereinafter), the fluorescent surface 1*a* is concave when viewed from the outer circumference of a panel.

Also, another reason why the outer circumference of a panel is made concave will now be described. The orthogonal light passes straight through the fluorescent surface. However, the light having a certain angle is reflected in a shielding layer. The reflected light returns to the fluorescent surface to then be scattered within the particles of the fluorescent surface. Parts of the scattered light become the orthogonal light with respect to the fluorescent surface to pass through externally and the rest of the scattered light is repeatedly reflected in the shielding layer. Finally, the fluorescent surface is made concave so that the light passes straight through, thereby improving the luminance.

Such a projection TV has a cooling portion 2 on the front surface (screen side) of the Braun tube and a projection lens 3, as shown in FIG. 3, which functions as lenses for a light (electron beam) transmission. That is to say, the maximum amount of irradiated light from the fluorescent surface 1*a* of the Braun tube is made incident to the entrance pupil of the lens so that the luminance difference between the center portion and peripheral portion of the Braun tube 1 can be reduced.

In the conventional projection TV, where the screen width-to-length ratio is 4 to 3, the curvature radii of both a long side a and short side b are about 350 mm. Accordingly, assuming that the screen width-to-length ratio is 4 to 3 in order to meet the need of multimedia, if the long and short sides have equal length of curvature radius, since the light travelling toward the long side is not refracted the same amount as the light travelling toward the main axis, the homogeniety of the luminance in the peripheral portion of the screen is difficult to achieve.

SUMMARY OF THE INVENTION

To solve the aforemention problem, the present invention provides a Braun tube for a projection television receiver which can prevent the homogeneity of the luminance in the peripheral portion of a screen from being lowered by setting the curvature radius of a long side and short side to be different, where the screen width-to-length ratio is 16 to 9.

In, the Braun tube for a projection television receiver according to the present invention whose width-to-length ratio is 16 to 9, when the fluorescent surface is viewed from the outer circumference of a panel, the curvature radius of the long side thereof is made smaller than that of the short side thereof.

BRIEF DESCRIPTION OF THE DRAWINGS

The above objects and advantages of the present invention will become more apparent by describing in detail a preferred embodiment thereof with reference to the attached drawings in which:

FIG. 3 is a vertically sectional view showing the combination of a general Braun tube and lens;

FIGS. 4A and 4B are a plan view of a conventional Braun tube and the sectional view thereof along line A—A, respectively; and FIGS. 5A and 5B are a plan view of a Braun tube according to the present invention and the sectional view thereof along line B—B.

DETAILED DESCRIPTION OF THE INVENTION

Figure 1A:
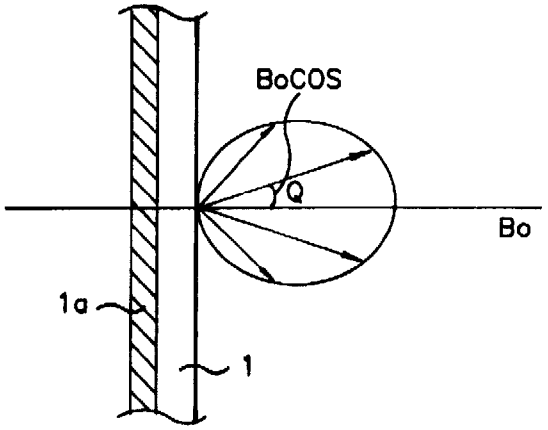
FIGS. 1A and 1B are schematic diagrams explaining geometrical properties of the light.
Figure 1B:
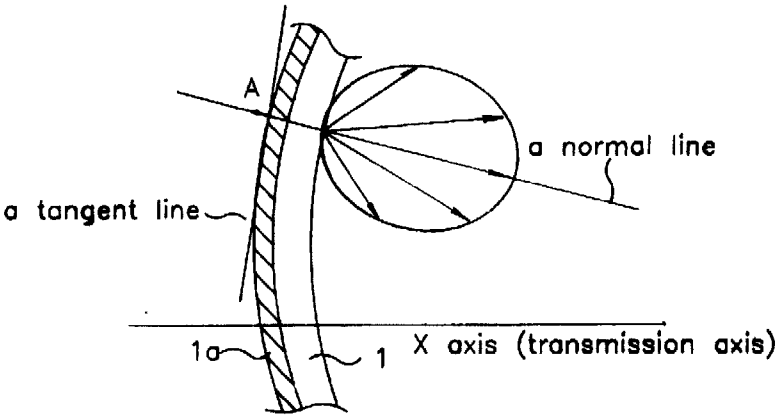
Figure 2A:
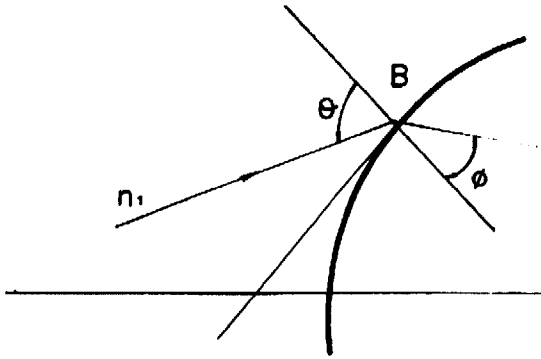
FIGS. 2A and 2B are schematic diagrams explaining Snell's law.
Figure 2B:
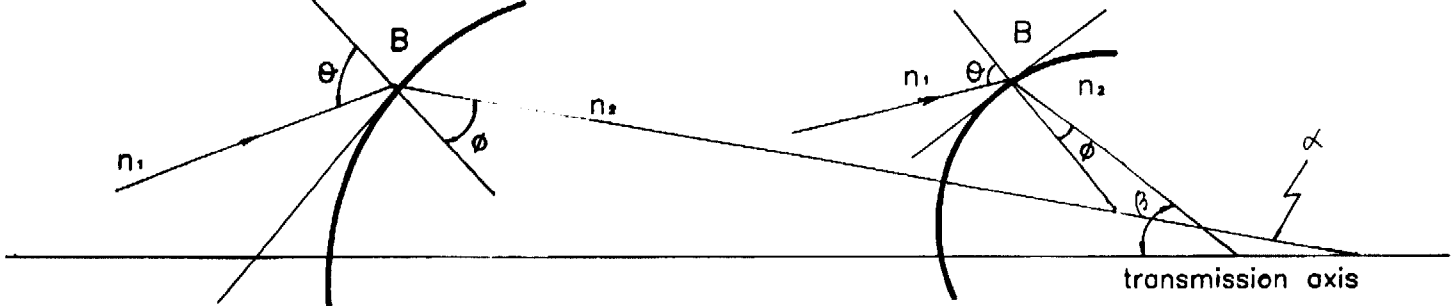

As shown in FIG. 5, the Braun tube for a projection TV according to the present invention is formed such that the curvature radius of the long side a is smaller than that of the short side b when the screen width-to-length ratio is 16 to 9.

According to the present invention described above, the homogeneity of the luminance is maintained so that the light incident to the central portion and peripheral portion of the short side b is refracted the same amount as in the conventional art, as described by Snell's law. Also, the light incident to the central portion and peripheral portion of the long side a is refracted the same amount as in the conventional art. In addition, the main axis of the light incident to the peripheral portion of the long side b, the curvature of the long side, is smaller so that the light incident to the peripheral portion of the screen is refracted more toward the center portion of the screen than the other portion thereof. That is to say, the homogeneity of the luminance for the long side b is also maintained.

As described above, according to the present invention, since the refraction amount of the light is increased for the lengthened long side due to a small curvature radius of the long side, the luminance of the overall screen is maintained homogeneously.

What is claimed is:

1. A projection television, comprising:

a screen; and a Braun tube for a projection television receiver, the Braun tube including a fluorescent surface having a long side and a short side, wherein a curvature radius of the long side of the fluorescent surface is less than a curvature radius of the short side of the fluorescent surface, and wherein the fluorescent surface is convex relative to the interior of the Braun tube.

2. The projection television of claim 1, wherein the screen has a width-to-length ratio of 16 to 9.

* * * * *